US005820955A

United States Patent [19]

Brander

[11] Patent Number: 5,820,955

[45] Date of Patent: Oct. 13, 1998

[54] ABSORBENT CONTAINER

[76] Inventor: William M. Brander, 280 Hallah Cir., Atlanta, Ga. 30328

[21] Appl. No.: 787,839

[22] Filed: Jan. 23, 1997

Related U.S. Application Data

[60] Provisional application No. 60/010,454 Jan. 23, 1996.

[51] Int. Cl.[6] ..... B29D 22/00; D02G 3/00; B32B 5/16; B05D 81/26

[52] U.S. Cl. ..... 428/35.7; 428/361; 428/378; 428/327; 428/454; 428/201; 428/326; 428/34.9; 428/35.2; 206/204; 524/35; 252/194

[58] Field of Search ..... 428/35.7, 34.9, 428/36.1, 201, 454, 327, 326, 35.2, 378; 206/204; 426/124; 524/35

[56] References Cited

U.S. PATENT DOCUMENTS

| | | | |
|---|---|---|---|
| 3,670,731 | 6/1972 | Harmon | 128/284 |
| 3,935,363 | 1/1976 | Burkholder et al. | 428/281 |
| 3,981,100 | 9/1976 | Weaver et al. | 47/58 |
| 3,993,553 | 11/1976 | Assarsson et al. | 204/159 |
| 4,382,507 | 5/1983 | Miller | 206/204 |
| 4,410,578 | 10/1983 | Miller | 428/117 |
| 4,454,055 | 6/1984 | Richman et al. | 252/194 |
| 4,487,791 | 12/1984 | Komatsu et al. | 428/35 |
| 4,615,923 | 10/1986 | Marx | 428/35 |
| 4,742,908 | 5/1988 | Thomas, Jr. et al. | 206/204 |
| 4,815,590 | 3/1989 | Peppiatt et al. | 206/204 |
| 4,914,066 | 4/1990 | Woodrum | 502/62 |
| 4,929,480 | 5/1990 | Midkiff et al. | 428/35.6 |
| 4,940,621 | 7/1990 | Rhodes et al. | 428/137 |
| 5,022,945 | 6/1991 | Rhodes et al. | 156/253 |
| 5,055,332 | 10/1991 | Rhodes et al. | 428/74 |
| 5,176,930 | 1/1993 | Kannankeril et al. | 426/124 |
| 5,356,678 | 10/1994 | Heitzhaus et al. | 428/35.6 |
| 5,552,169 | 9/1996 | Kannankeril et al. | 426/107 |
| 5,709,089 | 1/1998 | Dawson et al. | 62/4 |

FOREIGN PATENT DOCUMENTS

| | | |
|---|---|---|
| 56005164 | 1/1981 | Japan . |

*Primary Examiner*—Susan A. Loring
*Assistant Examiner*—S. Devi
*Attorney, Agent, or Firm*—Thomas, Kayden, Horstemeyer & Risley

[57] ABSTRACT

An absorbent composition of matter including a non-crosslinked gel forming polymer and at least one clay and preferably including a trivalent cation. The absorbency of the composition exceeds the sum of absorbencies of the components of the blend. The gel formed as a result of absorbency of fluid is non-slimy and has a high gel strength. The composition can be used with food products when made with all food safe ingredients. An absorbent article incorporating the absorbent material can be used for storage of food products.

24 Claims, 2 Drawing Sheets

ABSORBENT CONTAINER

This application claims priority from U.S. Provisional patent application Ser. No. 60/010,454, filed Jan. 23, 1996.

FIELD OF THE INVENTION

The invention relates generally to moisture absorbent articles such as diapers, incontinence articles, feminine hygiene products such as tampons and pads, absorbent dressings, pads for food packaging, and the like. More particularly, the invention relates to compositions of matter for use in disposable articles for the absorption of water, urine, blood, and other fluids and to an absorbent pouch for storing food products.

BACKGROUND OF THE INVENTION

There has been abundant activity in recent years in the area of absorbent compositions and articles incorporating the same, such as diapers, incontinence articles, feminine hygiene products, absorbent dressings, and food packaging. The prior art teaches the use of water insoluble crosslinked polymeric substances which possess the ability to absorb large quantities of fluids relative to their own weight and volume. Such polymeric materials include starch graft copolymers, crosslinked salts of acrylic acid, in particular sodium polyacrylate, and crosslinked cellulose derivatives, including crosslinked sodium carboxymethylcellulose (CMC). Many of the listed polymers are not approved as safe for incorporation into or contact with food products. Some types of non-crosslinked CMC, however, have been approved for use in food applications.

It is well known that non-crosslinked cellulose derivatives, such as from CMC, hydroxyethylcellulose, methylcellulose, and hydroxypropylmethylcellulose, produce a soft gel when hydrated, having low gel strength, and an unpleasant slippery (slime like) feel. This mitigates against their use, particularly in food packaging applications. Further, the gel formed from such materials can produce a gel block effect when used in absorbent articles. Gel block effect refers to the tendency of a gel to form around the masses of CMC particles, thus slowing or preventing fluid from being taken up by the internally-situated particles. This minimizes the usable absorbent capacity of the material.

The gel block effect can be minimized by using crosslinked CMC. This also has the effect of strengthening the gel. However, the cost of chemically crosslinked CMC in granular form has prevented its commercial development. Its use in food packaging would also require formal FDA approval, because of the chemical processes involved in preparing the crosslinked material.

Clays, and other mineral compositions such as diatomaceous earth, are known for their aqueous liquid absorbing properties. However, the use of clay, alone, may be problematic for some applications, due to its colloidal, dispersive properties in water. To this effect, the prior art teaches the use of clays in combination with other ingredients such as polymers. For example, U.S. Pat. No. 3,935,363 to Burkholder et al. teaches that clay minerals have enhanced water absorbing properties when flocculated into granular aggregates using small amounts of an inorganic salt solution and/or a water soluble polymeric flocculating agent such as polyacrylic acid and then dried. U.S. Pat. No. 4,914,066 to Woodrum teaches a blend of bentonite clay (>85%) and a water swellable but water insoluble organic polymeric hydrocolloid for improved absorbency in cat litter applications. U.S. Pat. No. 4,615,923 to Marx discloses a dry blend of kieselguhr (diatomaceous earth) with organic gel formers (CMC, starch, dextrose, gelatin, etc.) for use in absorbent pads for food packaging.

Another absorbent composition is taught in U.S. Pat. No. 4,454,055 to Richman et al. Which discloses a dry, water swellable absorbent composition comprising a blend of a water insoluble absorbent polymer such as an ionically complexed anionic polyelectrolyte, a polysaccharide graft polymer, or a covalently linked anionic polyelectrolyte with an extender material selected from non-crosslinked cellulose derivatives, starch, certain clays and materials, and mixtures thereof. The extender material(s) comprise from 1 to 75% by weight of the blend. It is stated that these blends provide significantly greater absorbency than would be expected from the sum of the individual absorbencies of the ingredients.

Meat and poultry food products are typically sold in a supporting tray that is overwrapped by a transparent plastic film, enabling visual inspection of the food products. To avoid the accumulation of exuded fluids from the food products, an absorbent pad is often placed in the supporting tray. The simplest types of absorbent pads for absorbing food product fluids consist essentially of a bundle of sheets of absorbent paper with or without a sheet of plastic film below the bundle. A sheet of plastic film may also be placed over the bundle of paper sheets. One or both of the sheets of plastic film is typically perforated or is otherwise fluid pervious.

In some configurations, the paper sheets have been replaced with a more absorbent material. For example, U.S. Pat. Nos. 4,940,621, 5,022,945, and 5,055,332 to Rhodes disclose a structure incorporating cellulose pulp fibers alone or mixed with polyolefin fibers and possibly including superabsorbent granules dispersed and held within the fiber structure. U.S. Pat. No. 5,176,930 to Kannankeril describes an absorbent pad comprising a mat of liquid absorbent material (cellulose fluff) enclosed between upper and lower sheets of plastic film with the lower sheet perforated to allow fluid to flow into the pad from the under side by capillary action. Another change to increase the absorbency of a pad taught in U.S. Pat. No. 5,176,930 involves a structural change in which a portion of the intermediate layer is allowed to extend to the periphery of the pad so as to contact fluid and wick it into the absorbent layers of the pad.

A disadvantage of the above discussed types of absorbent pads is that cellulose fluff has a low absorbency (up to about 3.5 grams per gram) and does not retain moisture under pressure. In addition these types of pads tend to break up in use so that paper, fluff, and film may adhere to the food and leakage may occur from the packages.

One way to solve the problem of leakage has been the incorporation of absorbent pads into plastic bags as described in U.S. Pat. Nos. 4,742,908 to Thomas, Jr. et al. and 4,815,590 to Pepplatt et al., both of which teach bags having an absorbent pad inserted mechanically into the bag and attached to one panel of the bag by thermal welding or glue or other adhesive means.

It is an object of the present invention to provide new dry, solid, fluid swellable, fluid absorbing compositions of matter that have improved absorbency and gel strength properties, and present minimum gel block effect.

It is an object of the present invention to provide new fluid absorbing compositions of matter that exhibit a minimum of syneresis.

It is a further object of the present invention to provide structures for absorbent articles prepared from the materials of the invention.

Yet another object of the present invention is to provide a new type of package incorporating food safety approved absorbents which incorporates an absorbent panel as part of the package. Such a package could be used for packaging of fresh poultry, meats, seafood, fresh cut fruits, vegetables, and other products that exude fluids, and will allow extended shelf life of the foods packaged therein under conditions appropriate for the particular food stuff.

SUMMARY OF THE INVENTION

Figure 1:
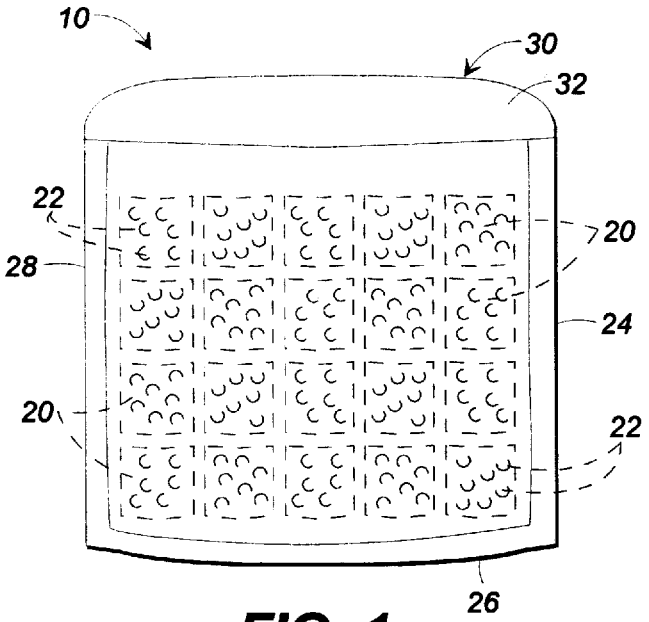
FIG. 1 is a top plan view of an absorbent article made according to the present invention.

In order to achieve the above and other objects, an absorbent material is provided which is a blend of at least one non-crosslinked gel forming polymer, at least one clay, and at least one trivalent cation. In addition, the composition can include diatomaceous earth in place of some of the clay. Further, natural gums such as xanthan, guars, and alginates can be added as can inorganic buffers. The absorbency of the blend exceeds the sum of the absorbencies of the individual components of the blend.

The gel formed as a result of absorption of fluid has high gel strength and exhibits a low level of gel block effect. In the case of food packaging applications, all components of the blend can be selected from materials known to be regulated by FDA as GRAS (generally regarded as safe) for incorporation in foods. The absorbent material of this invention is believed to be the only food safe absorbent that also provides the necessary gel strength and absorbency criteria for food packaging applications.

The non-crosslinked gel forming polymer can include cellulose derivatives, such as CMC and salts thereof, hydroxyethylcellulose, methylcellulose, hydroxypropylmethylcellulose, and also gelatinized starches, gelatin, dextrose, and the like, and mixtures thereof. The clay component can include attapulgite, montmorillonite (including bentonite clays), hectorite, sericite, kaolin, and mixtures thereof. A portion of the clay can be replaced with diatomaceous earth. The trivalent cation can be derived from aluminum sulfate, potassium aluminum sulfate, and other soluble salts of trivalent metal ions such as aluminum, chromium, and the like. The inorganic buffer can be one such as sodium carbonate (soda ash), sodium hexametaphosphate, sodium tripolyphosphate, and the like.

A method of agglomeration of the blend is described which enhances the rate of absorbency as well as increases the maximum total absorbency of the material and improves the strength of the gel formed on hydration of the material.

Structures for absorbent articles prepared from the absorbent material are described.

A new type of package for fresh foods is described which incorporates an absorbent panel that contains an absorbent material such as the absorbent material of the present invention. The package comprises a two walled bag or pouch wherein one wall is a moisture impervious thermoplastic such as polyethylene, having a desired oxygen transmission rate (OTR). The second, absorbent, wall has two plies with the outer ply being moisture impervious and made out of polyester, for example, and the inner ply being permeable to fluids and wherein an absorbent material, such as that disclosed herein, is trapped between the two plies. The two plies of the second wall are heat sealed together in a pattern so that pockets or cells are created containing the absorbent material. The bag is heat sealed around three sides and the fourth side or end can be folded over and heat sealed to the bag to seal the package.

DETAILED DESCRIPTION

The Absorbent Material

The absorbent material contains from about 10 to 90%, preferably from about 50 to about 80%, and most preferably from about 70 to 75% polymer. (All percentages recited herein refer to weight percentages.) The non-crosslinked gel forming polymer can be a cellulose derivative such as carboxymethylcellulose (CMC) and salts thereof, hydroxyethylcellulose, methylcellulose, hydroxypropylmethylcellulose, gelatinized starches, gelatin, dextrose, and other similar components, and may be a mixture of the above. Certain types and grades of CMC are approved for use with food items and are preferred when the absorbent is to be so used. The preferred polymer is a CMC, most preferably sodium salt of CMC having a degree of substitution of about 0.7 to 0.9. The degree of substitution refers to the proportion of hydroxyl groups in the cellulose molecule that have their hydrogen substituted by a carboxymethyl group. The viscosity of a 1% solution at 25° C., read on a Brookfield viscometer, should be in the range of about 2500 to 12,000 mPa. The CMC used in the Examples following was obtained from Hercules, Inc. of Wilmington, Del. (under the tradename B315) or from AKZO Nobel of Stratford, Conn. (under the tradename AF3085).

The clay ingredient can be any of a variety of materials and is preferably attapulgite, montmorillonite (including bentonite clays such as hectorite), sericite, kaolin, diatomaceous earth, silica, and other similar materials, and mixtures thereof. Preferably, bentonite is used. Bentonite is a type of montmorillonite and is principally a colloidal hydrated aluminum silicate and contains varying quantities of iron, alkali, and alkaline earths. The preferred type of bentonite is hectorite which is mined from specific areas, principally in Nevada. Bentonite used in the Examples following was obtained from American Colloid Company of Arlington Heights, Ill. under the tradename Bentonite AE-H.

Diatomaceous earth is formed from the fossilized remains of diatoms, which are structured somewhat like honeycomb or sponge. Diatomaceous earth absorbs fluids without swelling by accumulating the fluids in the interstices of the structure. Diatomaceous earth was obtained from American Colloid Company.

The clay and diatomaceous earth is present in an amount from about 10–90%, preferably about 20–30%. The diatomaceous earth can replace nearly all of the clay, up to about 2% remaining clay.

The trivalent cation is preferably provided in a soluble salt such as derived from aluminum sulfate, potassium aluminum sulfate, and other soluble salts of metal ions such as aluminum, chromium, and the like. Preferably, the trivalent cation is present at about 1 to 20%, most preferably at about 1 to 8%.

The inorganic buffer is one such as sodium carbonate (soda ash), sodium hexametaphosphate, sodium tripolyphosphate, and other similar materials. If a buffer is used, it is present preferably at about 0.6%.

The mixture of the non-crosslinked gel forming polymer, trivalent cation, and clay forms an absorbent material which when hydrated has an improved gel strength over the non-crosslinked gel forming polymer alone. Further, the gel exhibits minimal syneresis, which is exudation of the liquid component of a gel.

In addition, the combined ingredients form an absorbent which has an absorbent capacity which exceeds the total absorbent capacity of the ingredients individually. It appears that the trivalent cation provides a cross-linking effect on the CMC once in solution, and that the clay swells to absorb and stabilize the gels. However, the mechanism of action and the synergistic effect is not yet clear. Further, as shown by Example D following, it appears that, in some cases at least, it is not necessary to add trivalent cation. It is thought that perhaps a sufficient amount of trivalent cation is present in the bentonite and diatomaceous earth to provide the crosslinking effect.

The gels formed by the absorbent material of the invention are glass clear, firm gels which may have applications in other areas such as for cosmetic materials. Preferred embodiments of the invention are set forth in Table 1.

As used in Table 1, absorption is defined as the increased weight achieved in an absorbent pad structure of the type described herein, following placement of such pad in a tray-type container with 0.2% saline therein in such quantities as to not limit the access of fluid to the pad for up to 72–96 hours until no further increase of weight is apparent. The net absorption is the difference between the final weight of the pad and the dry starting weight, after deducting the net absorbency of the base pad material other than the absorbent blend i.e. the fabric component. This is converted to a gram/gram number by dividing the net absorption by the total weight of absorbent blend incorporated in the pad. Such a procedure is accurate for comparative purposes when the pad structure used is the same for all the tested blends, which was the case in the examples given.

The solvent used may be water, saline of various salt concentrations up to 4%, or fluids from meats, poultry, fruits, or other produce. 0.2% saline simulates fluids from poultry parts.

TABLE 1

EXAMPLES OF PREFERRED EMBODIMENTS

| | Ingredient | weight % | Absorbency – gm/gm: Individual Ingredient | Expected from Summation | Actual | Actual/ Expected |
|---|---|---|---|---|---|---|
| A | CMC-B315 | 71.3 | 35 | | | |
| | Potassium Aluminum Sulfate | 6.19 | 0 | 26.59 | 43.12 | 162.17% |
| | Bentonite | 22.5 | 7 | | | |
| B | CMC-AF3085 | 71.2 | 35 | | | |
| | Potassium Aluminum Sulfate | 6.32 | 0 | 27.5 | 53.94 | 196.15% |
| | Diatomaceous Earth | 20.2 | 12 | | | |
| | Bentonite | 2.25 | 7 | | | |
| C | CMC-AF3085 | 74.4 | 35 | | | |
| | Potassium Aluminum Sulfate | 1.47 | 0 | | | |
| | Diatomaceous Earth | 21.2 | 12 | 28.75 | 65.37 | 227.37% |
| | Bentonite | 2.35 | 7 | | | |
| | Soda Ash (sodium carbonate) | 0.58 | 0 | | | |
| D | CMC-AF3085 | 70 | 35 | | | |
| | Diatomaceous Earth | 27 | 12 | 26.12 | 56.74 | 217.23% |
| | Bentonite | 3 | 7 | | | |
| E | granulated CMC-AF3085 | 70.7 | 35 | | | |
| | Potassium Aluminum Sulfate | 6.14 | 0 | 26.37 | 49.17 | 186.46% |
| | Bentonite | 23.2 | 7 | | | |
| F | CMC-AF3085 | 70.8 | 35 | | | |
| | Potassium Aluminum Sulfate | 6.89 | 0 | 27.35 | 51.79 | 189.36% |
| | Bentonite | 2.23 | 7 | | | |
| | Diatomaceous Earth | 20.1 | 12 | | | |
| G | CMC-AF3085 | 54.0 | 35 | 24.67 | 48.97 | 198.5% |
| | Bentonite | 40.0 | 7 | | | |
| | Alginate | 5.94 | 50 | | | |
| | Calcium Chloride | 0.06 | 0 | | | |
| H | CMC-AF3085 | 75.3 | 35 | 27.98 | 62.51 | 223.4% |
| | Bentonite | 23.2 | 7 | | | |
| | Potassium Aluminum Sulfate | 1.5 | 0 | | | |
| I | CMC-AF3085 | 73.5 | 35 | 27.35 | 64.42 | 235.5% |
| | Bentonite | 23.2 | 7 | | | |
| | Potassium Aluminum Sulfate | 3.3 | 0 | | | |
| J | CMC-B315 | 31.82 | 35 | 18.46 | 32.85 | 177.9% |
| | Diatomaceous Earth | 54.96 | 12 | | | |
| | Bentonite | 10.44 | 7 | | | |
| | Potassium Aluminum Sulfate | 2.78 | 0 | | | |

It is apparent from the Table that a significant synergistic effect has been achieved in the absorption behavior of these blends, resulting in dramatic improvement in absorption capacity of the blends compared to the individual components. As the non-CMC ingredients are of much lower cost than CMC itself, the blends achieve major reductions in cost per unit weight of absorption.

Significant increases in absorption are realized over a wide range of CMC concentrations. However, lower concentrations of CMC tend to produce a more slimy feeling gel that is offensive to consumers. The lower concentrations of CMC may be adequate for some applications such as packaging of large bulk amounts of food products for mass producers, where the end consumer does not see or feel the gel.

Method of Manufacture

The ingredients for the composition are mixed together and then formed into granules. It has been found that preferred embodiments of the invention may be agglomerated by processing without addition of chemicals in a compactor or disk type granulator or similar device to produce granules of uniform and controllable particle size. Granules so formed act as an absorbent with increased rate and capacity of absorption due to the increased surface area of the absorbent. The preferred granule size is from about 75 to 1,000 microns, more preferably from about 150 to 800 microns, and most preferably from about 250 to 600 microns, with the optimum size depending upon the application. Water or another binding agent may be applied to the blend while it is being agitated in the compactor or disk type granulator which may improve the uniformity of particle size. Further, this method is a way in which other ingredients can be included in the composition, such as surfactants, deodorants and anti-microbial agents.

Articles Incorporating the Absorbent Materials

The absorbent materials described herein can be used in disposable absorbent articles where the absorbent material is used directly in absorbent articles and in absorbent "core" structures where the absorbent material is blended with non-woven fibers or other media such that particles of the absorbent material are suspended within a web or core. Such structures are disclosed in U.S. Pat. Nos. 4,410,578 to Miller, 4,929,480 to Midkiff et al., 5,176,930 to Kannankeril et al., and 5,055,332 to Rhodes et al., the disclosures of which are incorporated herein in their entireties, by reference.

The absorbent material can be placed between laminations or layers of liquid permeable materials such as non-woven fabric, cellulose fiber webs, and the like. These liquid permeable layers can be laminated to a layer of impermeable material such as a polymeric film. The absorbent held between the layers or laminates will swell on contact with fluids permeating through the permeable layer of the lamination. The gel which forms retains the moisture within the structure of the absorbent article and is not released through the laminate. It is necessary to select the materials of the laminate such that the absorbent material is effectively retained within the laminated article while in the dry state, adequate permeation of fluid is possible through the permeable layer(s), and so that the gel is retained within the laminated layers and not released through the pores of the fabric layers.

The lamination may be constructed in such a way that the components of the lamination are sealed to each other in continuous fashion around the periphery of the absorbent article, or in cross hatch or quilted pattern to allow small amounts of the absorbent to be held in pockets within the absorbent structure. The cross hatch seals can be designed to create a cellular pattern of varying sizes and shapes dependent upon the level and uniformity of absorption needed for the particular application.

The distribution of particles of the absorbent material throughout the web makes a larger surface area of the absorbent accessible to the fluids being absorbed. The amount of absorbent to be used in the absorbent core or article will vary according to the intended use and those of skill in the art can determine by experiment what are the best combinations of absorbent and core materials to be used for a particular application.

Absorbent Package for Fresh Food Products

Figure 2:
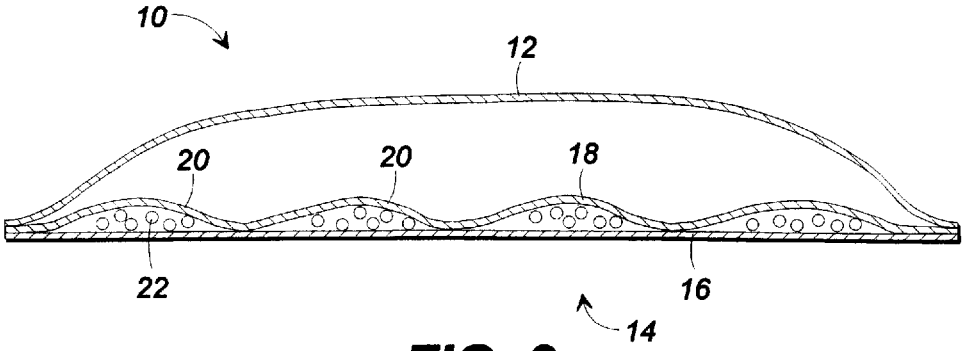
FIG. 2 is a side elevational view of the article of FIG. 1.

A specific embodiment of a laminated structure is illustrated in FIGS. 1 and 2. The structure is especially useful for storage of food products but may have other applications. The structure may be manufactured with the absorbent material of the present invention or the structure can employ absorbent materials currently known.

The absorbent package 10 comprises a two walled bag having a first wall 12 of a liquid impervious and preferably transparent thermoplastic such as polyethylene. This layer preferably has a low gas permeability for meat and poultry products but a higher gas permeability for fruit and vegetable products so as to allow ethylene to escape from inside the package and oxygen to move inside the package. The desired specific OTR (oxygen transport rate) of the layer will depend upon the foods to be packaged.

The second wall 14 of the bag is a laminated structure having at least two plies, a first ply 16 which is on the outside of the bag and comprises a liquid impervious thermoplastic such as polyester/polyethylene laminate and a second ply 18, which faces the food product, and comprises a liquid and gas permeable material. This material should be compatible with food items and can be a bi-component non-woven fabric comprised of fibers having a polyester core with a polyethylene sheath. The fabric is made through standard techniques such as by carding the fibers, passing the carded fibers through an oven, and then through nip rolls to "iron" the fabric into a more compact non-woven fabric. In addition, the heat and ironing cause fusion between the fibers. An open mesh fabric is created that is permeable to liquids and gases.

The non-woven permeable inner ply 18 is heat sealed to the polyester/polyethylene outer ply 16 in a pattern so as to form an array of cells 20. Prior to sealing of the plies in a pattern so as to form cells, an absorbent such as the one disclosed herein is placed between the two plies, so that a certain amount of absorbent 22 is trapped within each cell.

The resulting absorbent material can be fashioned into a number of different structure or flexible packages, such as pouches, thermoformed packs, lidding materials, or other packages. To form a pouch or bag as shown in FIG. 1, a large double walled sheath of material can be prepared and then cut to the desired size and heat sealed around three sides 24, 26, 28 to form a bag having an open side 30 with flap 32. The flap 32 can be an overlapping piece of either the polyethylene first wall or the polyester/polyethylene ply. After fillage with the product (such as diced fruit or tomatoes, poultry parts or meats) the flap 32 can be folded over and heat sealed to the bag. The presence of the array of cells makes possible the formation of various size bags from the double walled sheet having discrete absorbent areas and prevents spillage of absorbent from between the two plies. The two ply second wall can be made by standard techniques as can the two wall sheath of material and the two wall bags.

The permeable or inner ply of the absorbent wall can have a dual layer structure with two layers of the same fibers. The fibers are packed more closely together on the side which is closer to the absorbent and are packed into a more open network on the side closer to the packaged products. In this way the absorbent ply has smaller pores on the side closer to the absorbent and the absorbent is thus unlikely to migrate through the fabric. On the other hand, the ply next to the liquid has larger pores to encourage migration of the liquid therethrough.

Figure 3:
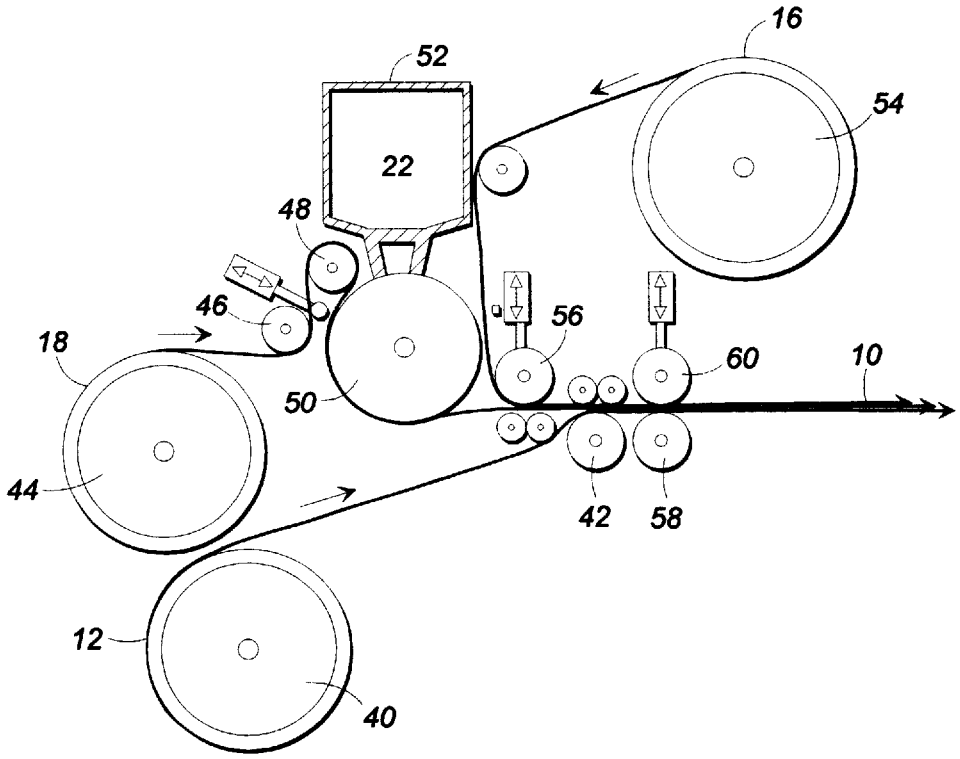
FIG. 3 is a schematic illustration of the apparatus used in a method of making an article of the present invention.

A method of making a sheet of absorbent material as described above is shown in FIG. 3. The thermoplastic film for first wall 12 is supplied from first supply roll 40 to second heated roll 42. The non-woven fabric 18 is supplied from second supply roll 44 to powder dispensing roller 50 via rollers 46 and 48. Absorbent powder 22 from dispensing hopper 52 is deposited onto fabric 18 as fabric 18 passes by roller 50. The thermoplastic film to form outer ply 16 of second wall 14 is delivered from supply roll 54 to first heated roller 56 that also receives fabric 18. Film 16 and fabric 18 are heat sealed together in the desired pattern by heated roller 56. The film to form first wall 12 is heat sealed to the combined film/fabric by second heated roll 42, third heated roll 58, and fourth heated roll 60 into bags 10 or other flexible packages of the desired shape and size.

While a specific embodiment of a flexible package is described above, the invention is not intended to be limited to the embodiment described. Other embodiments of flexible packages are envisioned utilizing the two ply absorbent fabric described above.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. An absorbent container suitable for storage of food products, said container comprising:

at least a first wall and a second wall;

said first wall being liquid impervious;

said second wall having at least a first ply and a second ply, wherein said first ply is liquid impervious and said second ply is liquid and gas permeable;

three sealed edges and a fourth unsealed edge on said first and second walls to form an open-ended pouch; and an absorbent material between said first and second plies;

wherein said second wall is formed as an integral, structural portion of the container and said first ply comprises an outside surface of the container.

2. The container of claim 1 wherein:

said first and second plies are bonded to each other in a pattern to form cells containing said absorbent material.

3. The container of claim 1, wherein a food product is placed within said open ended pouch and said fourth unsealed edge is sealed.

4. The container of claim 3, wherein said fourth unsealed edge is sealed by heat sealing.

5. An absorbent container suitable for storage of food products, said container comprising:

at least a first wall and a second wall;

said first wall being liquid impervious;

said second wall having at least a first ply and a second ply, wherein said first ply is liquid impervious and formed from a polyethylene/polyester copolymer film, and said second ply is liquid and gas permeable; and an absorbent material between said first and second plies;

wherein said second wall is formed as an integral, structural portion of the container and said first ply comprises an outside surface of the container.

6. An absorbent container suitable for storage of food products, said container comprising:

at least a first wall and a second wall;

said first wall being liquid impervious;

said second wall having at least a first ply and a second ply, wherein said first ply is liquid impervious and formed from a polyethylene/polypropylene copolymer film and said second ply is liquid and gas permeable; and an absorbent material between said first and second plies;

wherein said second wall is formed as an integral, structural portion of the container and said first ply comprises an outside surface of the container.

7. An absorbent container suitable for storage of food products, said container comprising:

at least a first wall and a second wall;

said first wall being liquid imperious;

said second wall having at least a first ply and a second ply, wherein said first ply is liquid impervious and said second ply is liquid and gas permeable; and an absorbent material between said first and second plies, said absorbent material having an absorbency of at least 15 grams/gram;

wherein said second wall is formed as an integral, structural portion of the container and said first ply comprises an outside surface of the container.

8. An absorbent container suitable for storage of food products, said container comprising:

at least a first wall and a second wall;

said first wall being liquid impervious;

said second wall having at least a first ply and a second ply, wherein said first ply is liquid impervious and said second ply is liquid and gas permeable; and an absorbent material between said first and second plies;

wherein said second wall is formed as an integral structural portion of the container and said first ply comprises an outside surface of the container and wherein said first and second plies form a portion of a lid for the container.

9. An absorbent container suitable for storage of food products, said container comprising:

at least a first wall and a second wall;

said first wall being liquid impervious;

said second wall having at least a first ply and a second ply, wherein said first ply is liquid impervious and said second ply is liquid and gas permeable; and an absorbent material between said first and second plies;

wherein said second wall is formed as an integral structure portion of the container and said first ply comprises an outside surface of the container and wherein said first and second walls form a portion of a thermoformed pack.

10. An absorbent container suitable for storage of food products which exude liquids, said container comprising:

at least a first wall and a second wall in overlying relationship and sealed together to form an open end pouch for receiving a food product;

said first wall being liquid impervious;

said second wall having at least a first ply for facing away from a food product in said pouch and a second ply juxtaposed said first ply for facing a food product in said pouch, wherein said first ply is liquid impervious and said second ply is liquid and gas permeable; and an absorbent material between said first and second plies of said second wall;

said first and second walls forming at least a portion of the outside surface of said pouch such that liquid exuded from the food products stored in the pouch are retained within said first and second walls;

said first and second plies bonded to each other to form cells with at least one of said cells containing said absorbent material.

11. The container of claim 10, wherein an equivalent amount of said absorbent material is contained in each of said cells.

12. The container of claim 10, wherein said first wall is gas impervious.

13. The container of claim 10, wherein said first ply is as impervious.

14. An absorbent container suitable for storage of food products, said container comprising:

at least a first wall and a second wall in overlying relationship and sealed together to form an open end pouch for receiving a food product;

said first wall being liquid impervious;

said second wall having at least a first ply for facing away from a food product in said pouch and a second ply juxtaposed said first ply for facing a food product in said pouch, wherein said first ply is liquid impervious and said second ply is liquid and gas permeable; and an absorbent material between said first and second plies of said second wall for absorbing liquid exuded from a food product in said pouch;

said first ply forming at least a portion of the outside surface of said pouch.

15. The container of claim 14 wherein:

said absorbent medium comprises a fabric comprised of non-woven fibers.

16. The absorbent container of claim 14 wherein said first wall is formed from a thermoplastic film.

17. The absorbent container of claim 14 wherein said first wall is formed from a polyethylene film.

18. The absorbent container of claim 14 wherein said first ply is formed from a thermoplastic film.

19. The absorbent container of claim 18 wherein said first ply is formed from a polyethylene film.

20. The absorbent container of claim 14 wherein said first ply is formed from a polyester film.

21. The absorbent container of claim 14 wherein said first ply is formed from a polypropylene film.

22. The absorbent container of claim 14 wherein said second ply is formed from a nonwoven fabric.

23. The absorbent container of claim 14, wherein said absorbent material is formed of at least one non-crosslinked gel forming polymer.

24. The absorbent container of claim 14, wherein said absorbent material is formed of at least one non-crosslinked gel forming polymer and at least one clay.

* * * * *

US005820955C1

(12) EX PARTE REEXAMINATION CERTIFICATE (5130th)

United States Patent
Brander

(10) Number: US 5,820,955 C1
(45) Certificate Issued: Jul. 5, 2005

(54) ABSORBENT CONTAINER

(75) Inventor: William M. Brander, 280 Hallah Cir., Atlanta, GA (US) 30328

(73) Assignee: William M. Brander, Atlanta, GA (US)

Reexamination Request:
No. 90/005,684, Mar. 27, 2000
No. 90/005,920, Feb. 1, 2001

Reexamination Certificate for:

| | |
|---|---|
| Patent No.: | **5,820,955** |
| Issued: | **Oct. 13, 1998** |
| Appl. No.: | **08/787,839** |
| Filed: | **Jan. 23, 1997** |

Related U.S. Application Data

(60) Provisional application No. 60/010,454, filed on Jan. 23, 1996.

(51) Int. Cl.[7] ..... B29D 22/00; B32B 5/16; B65D 85/00

(52) U.S. Cl. ..... 428/35.7; 428/35.2; 428/361; 428/378; 428/327; 428/454; 428/201; 428/326; 428/34.9; 206/204; 524/35; 252/194; 426/124; 426/127; 426/129; 426/410

(58) Field of Search ..... 428/35.2, 35.7, 428/35.4, 36.6, 36.7, 131, 192; 206/204; 383/109, 113; 426/127, 124, 125, 129, 410; 252/194; 604/367, 374, 385.01, 385.08, 385.19

(56) References Cited

U.S. PATENT DOCUMENTS

| | | | | |
|---|---|---|---|---|
| 3,026,209 A | | 3/1962 | Niblack et al. | 99/174 |
| 3,066,847 A | | 12/1962 | Fortune | 229/68 |
| 3,559,416 A | | 2/1971 | Cornwall | 62/4 |
| 3,670,731 A | | 6/1972 | Harmon | 128/284 |
| 3,935,363 A | | 1/1976 | Burkholder et al. | 428/281 |
| 3,981,100 A | | 9/1976 | Weaver et al. | 47/58 |
| 3,993,553 A | | 11/1976 | Assarsson et al. | 204/159.12 |
| 3,999,653 A | | 12/1976 | Haigh et al. | 206/584 |
| 4,181,285 A | | 1/1980 | Vangedal-Nielsen | 249/61 |
| 4,382,507 A | | 5/1983 | Miller | 206/204 |
| 4,404,820 A | | 9/1983 | Romaine | 62/530 |
| 4,410,578 A | | 10/1983 | Miller | 428/117 |
| 4,454,055 A | | 6/1984 | Richman et al. | 252/194 |
| 4,487,791 A | | 12/1984 | Komatsu et al. | 428/35 |
| 4,573,578 A | | 3/1986 | Greminger, Jr. et al. | 206/524.4 |
| 4,596,250 A | | 6/1986 | Beisang, III et al. | 128/402 |
| 4,615,923 A | | 10/1986 | Marx | 428/35 |
| 4,619,361 A | | 10/1986 | Thomas, Jr. | 206/204 |
| 4,742,908 A | | 5/1988 | Thomas, Jr. et al. | 206/204 |
| 4,778,697 A | * | 10/1988 | Genske et al. | 428/35.2 |
| 4,780,117 A | | 10/1988 | Lahey et al. | 62/4 |
| 4,815,590 A | | 3/1989 | Peppiatt et al. | 206/204 |
| 4,856,651 A | | 8/1989 | Francis, Jr. | 206/219 |
| 4,861,632 A | | 8/1989 | Caggiano | 428/35.2 |
| 4,914,066 A | | 4/1990 | Woodrum | 502/62 |
| 4,927,010 A | | 5/1990 | Kannankerial | 206/204 |
| 4,929,480 A | | 5/1990 | Midkiff et al. | 428/35.6 |
| 4,940,621 A | | 7/1990 | Rhodes et al. | 428/137 |
| 4,984,908 A | | 1/1991 | Kronenberger et al. | 384/478 |
| 5,022,945 A | | 6/1991 | Rhodes et al. | 156/253 |

(Continued)

FOREIGN PATENT DOCUMENTS

| | | |
|---|---|---|
| WO | WO 98/25835 | 6/1998 |

OTHER PUBLICATIONS

S. Devi, Notification of Transmittal of International Preliminary Examination Report, May 17, 2000, 17 pages (complete report).

S. Smith, Patents Act 1977: Examination Report Under Section 18(3), Jun. 23, 2000, 4 pages (complete report).

*Primary Examiner*—Rena L. Dye

(57) ABSTRACT

An absorbent composition of matter including a non-crosslinked gel forming polymer and at least one clay and preferably including a trivalent cation. The absorbency of the composition exceeds the sum of absorbencies of the components of the blend. The gel formed as a result of absorbency of fluid is non-slimy and has a high gel strength. The composition can be used with food products when made with all food safe ingredients. An absorbent article incorporating the absorbent material can be used for storage of food products.

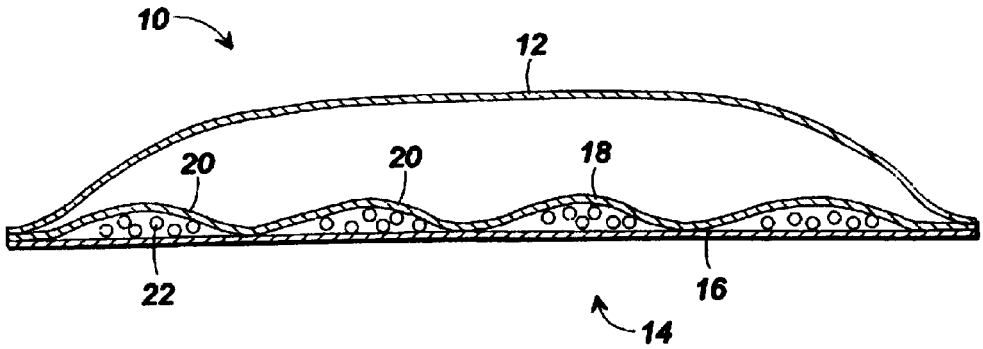

U.S. PATENT DOCUMENTS

| | | | | |
|---|---|---|---|---|
| 5,031,418 | A | | 7/1991 | Hirayama et al. ..... 62/530 |
| 5,035,241 | A | | 7/1991 | Walasek et al. ..... 128/403 |
| 5,054,290 | A | | 10/1991 | Hogan ..... 62/45.1 |
| 5,055,332 | A | | 10/1991 | Rhodes et al. ..... 428/74 |
| 5,150,707 | A | | 9/1992 | Anderson ..... 128/402 |
| 5,176,930 | A | | 1/1993 | Kannankeril et al. ..... 426/124 |
| 5,263,479 | A | | 11/1993 | Tesch ..... 607/114 |
| 5,265,401 | A | | 11/1993 | Gujer et al. ..... 53/546 |
| 5,271,244 | A | | 12/1993 | Staggs ..... 62/457.3 |
| 5,356,678 | A | | 10/1994 | Heitzhaus et al. ..... 428/35.6 |
| 5,372,429 | A | | 12/1994 | Beaver, Jr. et al. ..... 383/109 |
| 5,386,803 | A | | 2/1995 | Hughes ..... 119/173 |
| 5,393,462 | A | | 2/1995 | Avery ..... 252/315.5 |
| 5,417,276 | A | | 5/1995 | Dobry ..... 165/10 |
| 5,447,532 | A | | 9/1995 | Furuya ..... 607/114 |
| 5,552,169 | A | | 9/1996 | Kannankeril et al. ..... 426/107 |
| 5,649,409 | A | * | 7/1997 | Gujer et al. ..... 53/461 |
| 5,660,868 | A | * | 8/1997 | Yeager ..... 426/124 |
| 5,709,089 | A | | 1/1998 | Dawson et al. ..... 62/4 |

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 8 is cancelled.

Claims 1, 5–7, 9, 10, 13 and 14 are determined to be patentable as amended.

Claims 2–4, 11, 12 and 15–24, dependent on an amended claim, are determined to be patentable.

New claims 25–98 are added and determined to be patentable.

1. An absorbent container suitable for storage of food products, said container comprising:

at least a first wall and a second wall;

said first wall being liquid impervious;

said second wall having at least a first ply and a second ply, wherein said first ply is liquid impervious and said second ply *is positioned between said first ply and said first wall and* is liquid and gas permeable;

three sealed edges and a fourth unsealed edge on said first and second walls to form an open-ended pouch; [and]

an absorbent material between said first and second plies;

*said absorbent material being configured to form a gel when contacted by liquids exuded from food products;* wherein said second wall is formed as an integral, structural portion of the container and said first ply comprises an outside surface of the container*;*

*a food product that exudes liquid placed within said container between said first wall and said second wall;*

*some of said liquid has exuded from said food product and has passed from said food product through said second ply of said second wall and contacted said absorbent material positioned between said first ply and second ply of said second wall; and*

*said absorbent material has absorbed at least some of said liquid exuded from said food product and formed a gel such that said at least some of said liquid is prevented from re-contacting said food product by being retained in said absorbent material away from said food product by said second ply.*

5. An absorbent container suitable for storage of food products, said container comprising:

at least a first wall and a second wall;

said first wall being liquid impervious;

said second wall having at least a first ply and a second ply, wherein said first ply is liquid impervious and formed from a polyethylene/polyester copolymer film, and said second ply is liquid and gas permeable; [and]

*a food product that exudes liquid placed between said first and second walls;* an absorbent material between said first and second plies[;] *of said second wall, said absorbent material being configured to form a gel when contacted by liquids exuded from food products;* wherein said second wall is formed as an integral, structural portion of the container and said first ply comprises an outside surface of the container*;*

*some of said liquid has exuded from said food product and has passed from said food product through said second ply of said second wall and contacted said absorbent material positioned between said first ply and second ply of said second wall; and*

*said absorbent material has absorbed at least some of said liquid exuded from said food product and formed a gel such that said at least some of said liquid is prevented from re-contacting said food product by being retained in said absorbent material away from said food product by said second ply.*

6. An absorbent container suitable for storage of food products, said container comprising:

at least a first wall and a second wall;

said first wall being liquid impervious;

said second wall having at least a first ply and a second ply, wherein said first ply is liquid impervious and formed from a polyethylene/polypropylene copolymer film and said second ply is liquid and gas permeable; [and]

an absorbent material between said first and second plies*, said absorbent material configured to form a gel when absorbing liquids exuded from food products*;

wherein said second wall is formed as an integral, structural portion of the container and said first ply comprises an outside surface of the container*;*

*a food product that exudes liquid placed within said container between said first wall and said second wall;*

*some of said liquid has exuded from said food product and has passed from said food product through said second ply of said second wall and contacted said absorbent material positioned between said first ply and said second ply of said second wall;*

*said absorbent material has absorbed at least some of said liquid exuded from said food product; and*

*said absorbed liquid is prevented from re-contacting said food product by being retained and in said absorbent material away from said food product by said second ply.*

7. An absorbent container suitable for storage of food products, said container comprising:

at least a first wall and a second wall;

said first wall being liquid [imperious] *impervious*;

said second wall having at least a first ply and a second ply, wherein said first ply is liquid impervious and said second ply is liquid and gas permeable; [and]

an absorbent material between said first and second plies, said absorbent material having an absorbency of at least 15 grams/gram;

*said absorbent material being configured to form a gel when absorbing liquids exuded from food products;* wherein said second wall is formed as an integral, structural portion of the container and said first ply comprises an outside surface of the container*;*

*a food product that exudes liquid placed within said container between said first wall and said second wall;*

*some of said liquid has exuded from said food product and has passed from said food product through said second*

*ply of said second wall and contacted said absorbent material positioned between said first ply and second ply of said second wall; and*

*said absorbent material has absorbed at least some of said liquid exuded from said food product and formed a gel such that said at least some of said liquid is prevented from re-contacting said food product by being retained in said gel and away from said food product by said second ply.*

9. An absorbent container suitable for storage of food products, said container comprising:

at least a first wall and a second wall;

said first wall being *transparent and* liquid impervious;

said second wall having at least a first ply and a second ply, wherein said first ply is liquid impervious and said second ply is liquid and gas permeable; and an absorbent material between said first and second plies, *said absorbent material being configured to form a gel when contacted by liquids exuded from food products*;

wherein said second wall is formed as an integral [structure], *structural* portion of the container and said first ply comprises an outside surface of the container, [and] wherein said first and second walls form a portion of a thermoformed pack *configured as a pouch,*

*a food product that exudes liquid has been placed within said container between said first wall and said second wall, and said walls have been sealed about said food product;*

*liquid has exuded from said food product;*

*some of said liquid exuded from said food product has passed from said food product through said second ply of said second wall and contacted said absorbent material positioned between said first ply and said second ply of said second wall; and*

*said absorbent material has absorbed at least some of said liquid exuded from said food product and formed a gel such that said at least some of said liquid is prevented from re-contacting said food product by being retained in said gel and away from said food product by said second ply.*

10. An absorbent container suitable for storage of food products which exude liquids, said container comprising:

at least a first wall and a second wall in overlying relationship and sealed together to form an open end pouch for receiving a food product;

*a food product that exudes liquid positioned in said pouch between said first and second walls;* said first wall being liquid impervious;

said second wall having at least a first ply for facing away from a food product in said pouch and a second ply juxtaposed said first ply for facing a food product in said pouch, wherein said first ply is liquid impervious and said second ply is liquid and gas permeable; [and]

[an] *a gel forming* absorbent material between said first and second plies of said second wall;

said first and second walls forming at least a portion of the outside surface of said pouch such that liquid exuded from the food products stored in the pouch are retained within said first and second *plies of said second* wall[s];

said first and second plies bonded to each other to form cells with at least one of said cells containing said absorbent material*;*

*some of said liquid has exuded from said food product and has passed from said food product through said second ply of said second wall and contacted said absorbent material positioned between said first ply and second ply of said second wall; and*

*said absorbent material has absorbed at least some of said liquid exuded from said food product and formed a gel such that said at least some of said liquid is prevented from re-contacting said food product by being retained in said gel and away from said food product by said second ply.*

13. The container of claim 10, wherein said first ply is [as] *gas* impervious.

14. An absorbent container suitable for storage of food products, said container comprising:

at least a first wall and a second wall in overlying relationship and sealed together to form an open end pouch for receiving a food product;

said first wall being liquid impervious;

said second wall having at least a first ply for facing away from a food product in said pouch and a second ply juxtaposed said first ply for facing a food product in said pouch, wherein said first ply is liquid impervious and said second ply is liquid and gas permeable; [and]

an absorbent material between said first and second plies of said second wall for absorbing liquid exuded from a food product in said pouch;

said first ply forming at least a portion of the outside surface of said pouch*;*

*a food product that exudes liquid placed within said container between said first wall and said second wall;*

*some of said liquid has exuded from said food product and has passed from said food product through said second ply of said second wall and contacted said absorbent material positioned between said first ply and second ply of said second wall; and*

*said absorbent material has absorbed at least some of said liquid exuded from said food product such that said at least some of said absorbed liquid is prevented from re-contacting said food product by being retained in said absorbent material and away from said food product by said second ply.*

*25. The container of claim 1, wherein said first ply and second ply are substantially coextensive.*

*26. The container of claim 1, further comprising:*

*a flap extending outwardly from said first wall and being configured to engage said second wall for sealing said pouch.*

*27. The container of claim 1, wherein said first wall and second wall are substantially coextensive.*

*28. The container of claim 1, wherein said food product has been selected from the group consisting of poultry and tomatoes.*

*29. The container of claim 1, wherein said food product is diced tomatoes.*

*30. The container of claim 5, wherein said first ply and second ply are substantially coextensive.*

*31. The container of claim 5, further comprising:*

*a flap extending outwardly from said first wall and being configured to engage said second wall for sealing said container.*

*32. The container of claim 5, wherein said first wall and said second wall form a pouch.*

*33. The container of claim 5, wherein said first wall and second wall are substantially coextensive.*

*34. The container of claim 5, wherein said container has been sealed about said food product.*

*35. The container of claim 5, wherein said food product has been selected from the group consisting of poultry and tomatoes.*

*36. The container of claim 5, wherein said food product is diced tomatoes.*

*37. The container of claim 6, wherein said first ply and second ply are substantially coextensive.*

*38. The container of claim 6, further comprising:*

*a flap extending outwardly from said first wall and being configured to engage said second wall for sealing said container.*

*39. The container of claim 6, wherein said first wall and said second wall form a pouch.*

*40. The container of claim 6, wherein said first wall and second wall are substantially coextensive.*

*41. The container of claim 6, wherein said container has been sealed about said food product.*

*42. The container of claim 6, wherein said food product has been selected from the group consisting of poultry and tomatoes.*

*43. The container of claim 6, wherein said food product is diced tomatoes.*

*44. The container of claim 7, wherein said first ply and second ply are substantially coextensive.*

*45. The container of claim 7, further comprising:*

*a flap extending outwardly from said first wall and being configured to engage said second wall for sealing said container.*

*46. The container of claim 7, wherein said first wall and said second wall form a pouch.*

*47. The container of claim 7, wherein said first wall and second wall are substantially coextensive.*

*48. The container of claim 7, wherein said container has been sealed about said food product.*

*49. The container of claim 7, wherein said food product has been selected from the group consisting of poultry and tomatoes.*

*50. The container of claim 7, wherein said food product is diced tomatoes.*

*51. The container of claim 9, wherein said first ply and second ply are substantially coextensive.*

*52. The container of claim 9, further comprising:*

*a flap extending outwardly from said first wall and being configured to engage said second wall for sealing said pouch.*

*53. The container of claim 9, wherein said first wall and second wall are substantially coextensive.*

*54. The container of claim 9, wherein said food product has been selected from the group consisting of poultry and tomatoes.*

*55. The container of claim 9, wherein said food product is diced tomatoes.*

*56. The container of claim 10, wherein said first ply and second ply are substantially coextensive.*

*57. The container of claim 10, further comprising:*

*a flap extending outwardly from said first wall and being configured to engage said second wall for sealing said pouch.*

*58. The container of claim 10, wherein said first wall and second wall are substantially coextensive.*

*59. The container of claim 10, wherein said container has been sealed about said food product.*

*60. The container of claim 59, wherein said pouch has been sealed about said food product by sealing a portion of said first wall to a portion of said second ply.*

*61. The container of claim 10, wherein said food product has been selected from the group consisting of poultry and tomatoes.*

*62. The container of claim 10, wherein said food product is diced tomatoes.*

*63. The container of claim 14, wherein said first ply and second ply are substantially coextensive.*

*64. The container of claim 14, further comprising:*

*a flap extending outwardly from said first wall and being configured to engage said second wall for sealing said pouch.*

*65. The container of claim 14, wherein said first wall and second wall are substantially coextensive.*

*66. The container of claim 14, wherein said container has been sealed about said food product.*

*67. The container of claim 14, wherein said pouch has been sealed about said food product by sealing a portion of said first wall to a portion of said second ply.*

*68. The container of claim 14, wherein said food product has been selected from the group consisting of poultry and tomatoes.*

*69. The container of claim 14, wherein said food product is diced tomatoes.*

*70. An absorbent container suitable for storage of food products that exude liquids, said container comprising:*

*at least a first wall and a second wall in overlying relationship and sealed together to form an open end pouch for receiving a food product;*

*said first wall being liquid impervious and forming at least a portion of the outside surface of said pouch;*

*said second wall having at least a first ply for facing away from a food product in said pouch and a second ply juxtaposed said first ply for facing a food product in said pouch, wherein said first ply is liquid impervious and said second ply is liquid and gas permeable, and said second ply is positioned between said first ply and said first wall;*

*said first wall overlying and sealed to said second wall to form a pouch there between;*

*an absorbent material positioned between said first and second plies of said second wall for absorbing liquid exuded from a food product in said pouch;*

*said absorbent material being formed of particles configured to form a gel when contacted by liquids exuded from food products;*

*said second wall being formed as an integral, structural portion of the container and said first ply forming at least a portion of the outside surface of said pouch;*

*a food product that exudes liquid arranged and sealed within said container between said first wall and said second ply of said second wall;*

*liquid has exuded from said food product;*

*some of said liquid exuded from said food product has passed from said food product through said second ply of said second wall and contacted said absorbent material positioned between said first ply and said second ply of said second wall; and*

*said absorbent material has absorbed at least some of said liquid exuded from said food product by forming a gel and said liquid absorbed by said absorbent material is prevented from re-contacting said food product by said gel being retained away from said food product by said second ply.*

*71. The container of claim 70, wherein said first ply and second ply are substantially coextensive.*

*72. The container of claim 70, wherein said first wall and second wall are substantially coextensive.*

*73. The container of claim 70, further comprising:*

*a flap extending outwardly from said first wall and being configured to engage said second wall for sealing said pouch, said food product being sealed within said container by said flap being sealed to said second wall.*

*74. The container of claim 70, wherein said pouch has been sealed about said food product by sealing a portion of said first wall to a portion of said second ply.*

*75. The container of claim 70, wherein said first wall is formed of transparent material.*

*76. The container of claim 70, wherein said food product is diced tomatoes.*

*77. The container of claim 70, wherein said food product is poultry.*

*78. An absorbent container suitable for storage of food products that exude liquids, said container comprising:*

*at least a first wall and a second wall in overlying relationship and defining therebetween a food-receiving pouch;*

*a food product that exudes a liquid positioned in said pouch;*

*said first wall being liquid impervious such that liquid exuded from said food product in said pouch is prevented from penetrating and being retained within at least a portion of said first wall;*

*said second wall having at least a first ply and a second ply, wherein said first ply is liquid impervious and formed from a polyethylene/polypropylene copolymer film, and said second ply is formed of a liquid and gas permeable material and is liquid and gas permeable;*

*an absorbent material between said first and second plies;*

*wherein said second wall is formed as an integral, structural portion of the container and said first ply comprises an outside surface of the container;*

*said absorbent material having absorbed liquid exuded from said food product; and*

*said second ply of said second wall retaining said absorbent material and liquid absorbed by said absorbent material away from said food product.*

*79. The absorbent container of claim 78, wherein said absorbent material is formed of particles configured to form a gel when contacted by liquids exuded from food products;*

*said absorbent material has absorbed at least some of said liquid exuded from said food product by forming a gel and said liquid absorbed by said absorbent material is prevented from re-contacting said food product by said gel being retained away from said food product by said second ply.*

*80. The container of claim 78, wherein said first ply and second ply are substantially coextensive.*

*81. The container of claim 78, wherein said first wall and second wall are substantially coextensive.*

*82. The container of claim 79, further comprising:*

*a flap extending outwardly from said first wall and being configured to engage said second wall for sealing said pouch, said food product being sealed within said container by said flap being sealed to said second wall.*

*83. The container of claim 79, wherein said pouch has been sealed about said food product by sealing a portion of said first wall to a portion of said second ply.*

*84. The container of claim 79, wherein said first wall is formed of transparent material.*

*85. The container of claim 79, wherein said food product is diced tomatoes.*

*86. The container of claim 79, wherein said food product is poultry.*

*87. An absorbent container suitable for storage of food products which exude liquids, said container comprising:*

*at least a first wall and a second wall in overlying relationship and sealed together to form an open end pouch for receiving a food product;*

*said first wall being liquid impervious;*

*said second wall having at least a first ply for facing away from a food product in said pouch and a second ply juxtaposed said first ply for facing a food product in said pouch, wherein said first ply is liquid impervious and said second ply is formed of a liquid and gas permeable material and is liquid and gas permeable;*

*an absorbent material between said first and second plies of said second wall;*

*a food product that exudes liquid arranged and sealed within said container between said first wall and said second wall;*

*some of said liquid has exuded from said food product;*

*some of said liquid exuded from said food product has passed from said food product through said second ply of said second wall and contacted said absorbent material positioned between said first ply and said second ply of said second wall; and*

*said absorbent material has absorbed at least some of said liquid exuded from said food product and said liquid absorbed by said absorbent material is prevented from re-contacting said food product by said absorbent material being retained away from said food product by said second ply;*

*said first and second walls forming at least a portion of the outside surface of said pouch such that liquid exuded from the food product stored in the pouch is retained within said first and second walls and away from said food product in said pouch;*

*said first and second plies bonded to each other to form cells with at least one of said cells containing said absorbent material.*

*88. The container of claim 87, wherein said first ply and second ply are substantially coextensive.*

*89. The container of claim 87, wherein said first wall and second wall are substantially coextensive.*

*90. The container of claim 87, further comprising:*

*a flap extending outwardly from said first wall and being configured to engage said second wall for sealing said pouch, said food product being sealed within said container by said flap being sealed to said second wall.*

*91. The container of claim 87, wherein said pouch has been sealed about said food product by sealing a portion of said first wall to a portion of said second ply.*

*92. The container of claim 87, wherein said first wall is formed of transparent material.*

*93. The container of claim 87, wherein said food product is diced tomatoes.*

*94. The container of claim 87, wherein said food product is poultry.*

*95. An absorbent container suitable for storage of food products, said container comprising:*

*at least a first wall and a second wall;*

*said first wall being liquid impervious;*

*said second wall having at least a first ply and a second ply, wherein said first ply is liquid impervious and said second ply is liquid and gas permeable; and*

*an absorbent material between said first and second plies,*

*said absorbent material being configured to form a gel when contacted by liquids exuded from food products;*

*wherein said second wall is formed as an integral structural portion of the container and said first ply comprises an outside surface of the container, and wherein said first and second plies form a portion of a lid for the container, and wherein;*

*a food product that exudes liquid positioned within said container between said first wall and said second wall;*

*some of said liquid has exuded from said food product;*

*some of said liquid exuded from said food product has passed from said food product through said second ply of said second wall and contacted said absorbent material positioned between said first ply and said second ply of second wall; and*

*said absorbent material has absorbed at least some of said liquid exuded from said food product and formed a gel such that said at least some of said liquid is prevented from re-contacting said food product by being retained away from said food product by said second ply.*

*96. The container of claim 95, wherein said first wall is transparent.*

*97. The container of claim 95, wherein said first wall is a single sheet of material.*

*98. An absorbent container suitable for storage of food products, said container comprising:*

*at least a first wall and a second wall;*

*said first wall being liquid impervious;*

*said second wall having at least a first ply and a second ply, wherein said first ply is liquid impervious and said second ply is liquid and gas permeable, and said second ply is positioned between said first ply and said first wall;*

*an absorbent material between said first and second plies;*

*said absorbent material being configured to form a gel when contacted by liquids exuded from food products;*

*wherein said second wall is formed as an integral structural portion of the container and said first ply comprises an outside surface of the container and wherein said first and second plies form a portion of a lid for the container;*

*a food product that exudes liquid placed within said container between said first wall and said second wall;*

*some of the liquid has exuded from the food product and has passed from the food product through said second ply of said second wall and contacted said absorbent material positioned between said first ply and said second ply of said second wall; and*

*said absorbent material has absorbed at least some of the liquid exuded from the food product and formed a gel between said first and second plies such that at least some of the liquid is prevented from re-contacting the food product by said gel being retained away from the food product by said second ply.*

* * * * *